US006449967B1

(12) United States Patent
Dubé

(10) Patent No.: US 6,449,967 B1
(45) Date of Patent: Sep. 17, 2002

(54) HIGH SPEED EVAPORATOR DEFROST SYSTEM

(76) Inventor: Serge Dubé, 2595 Bourgogne, St. Lazare, Quebec (CA), J0P 1V0

( * ) Notice: Subject to any disclaimer, the term of this patent is extended or adjusted under 35 U.S.C. 154(b) by 0 days.

(21) Appl. No.: 09/940,157

(22) Filed: Aug. 27, 2001

(30) Foreign Application Priority Data

Jun. 12, 2001 (CA) ..... 2350367

(51) Int. Cl.[7] ..... F25D 21/06
(52) U.S. Cl. ..... 62/156; 62/174; 62/278
(58) Field of Search ..... 62/156, 174, 278, 62/151, 152, 155, 126, 129, 81, 277, 509, 196.3, 196.4

(56) References Cited

U.S. PATENT DOCUMENTS 4,012,921 A * 3/1977 Willitts et al. ..... 62/278
4,979,371 A * 12/1990 Larson ..... 62/278 X
5,673,567 A * 10/1997 Dube ..... 62/196.4 X
6,000,231 A * 12/1999 Alsenz ..... 62/278 X
6,089,033 A * 7/2000 Dube ..... 62/156

* cited by examiner

*Primary Examiner*—Chen-Wen Jiang
(74) *Attorney, Agent, or Firm*—Swabey Ogilvy Renault; Guy J. Houle

(57) ABSTRACT

A high-speed evaporator defrost system is described. It comprises a defrost conduit circuit having valves for directing hot high pressure refrigerant gas from a discharge line of a compressor and through a refrigeration coil of an evaporator of a refrigeration system during a defrost cycle thereof, and back to a suction header of the compressor through a reservoir of the refrigeration system to remove any liquid refrigerant contained in the refrigerant gas prior to returning to the suction header. The reservoir has an internal pressure which is generally at the same pressure as that of a suction header of the compressor thereby creating a pressure differential across the refrigeration coil sufficient to accelerate the hot high pressure refrigerant gas in the discharge line through the refrigeration coil of the evaporator to quickly defrost the refrigeration coil. The reservoir is repressurized after the defrost cycle for using the reservoir in a refrigeration cycle.

20 Claims, 3 Drawing Sheets

HIGH SPEED EVAPORATOR DEFROST SYSTEM

FIELD OF THE INVENTION

The present invention relates to a high-speed evaporator defrost system for defrosting refrigeration coils of evaporators in a short period of time without having to increase compressor head pressure.

BACKGROUND OF THE INVENTION

In refrigeration systems found in the food industry to refrigerate fresh and frozen foods, it is necessary to defrost the refrigeration coils of the evaporators periodically, as the refrigeration systems working below the freezing point of water are gradually covered by a thin layer of frost which reduces the efficiency of evaporators. The evaporators become clogged up by the build up of ice thereon during the refrigeration cycle, whereby the passage of air maintaining the foodstuff refrigerated is obstructed. Exposing foodstuff to temperature increases due to defrost cycles may have adverse effects on their freshness and quality.

One method known in the prior art for defrosting refrigeration coils uses an air defrost method wherein fans blow warm air against the clogged up refrigeration coils while refrigerant supply is momentarily stopped from circulating through the coils. The resulting defrost cycles may last up to about 40 minutes, thereby possibly fouling the foodstuff.

In another known method, gas is taken from the top of the reservoir of refrigerant at a temperature ranging from 80° F. to 90° F. and is passed through the refrigeration coils, whereby the latent heat of the gas is used to defrost the refrigeration coils. This also results in a fairly lengthy defrost cycle.

U.S. Pat. No. 5,673,567, issued on Oct. 7, 1997 to the present inventor, discloses a system wherein hot gas from the compressor discharge line is fed to the refrigerant coil by a valve circuit and back into the liquid manifold to mix with the refrigerant liquid. This method of defrost usually takes about 12 minutes for defrosting evaporators associated with meat display cases and about 22 minutes for defrosting frozen food enclosures. The compressors are affected by hot gas coming back through the suction header, thereby causing the compressors to overheat. Furthermore, the energy costs may increase with the compressor head pressure increase.

U.S. Pat. No. 6,089,033, published on Jul. 18, 2000 to the present inventor, introduces an evaporator defrost system operating at high speed (e.g. 1 to 2 minutes for refrigerated display cases, 4 to 6 minutes for frozen food enclosures) comprising a defrost conduit circuit connected to the discharge line of the compressors and back to the suction header through an auxiliary reservoir capable of storing the entire refrigerant load of the refrigeration system. The auxiliary reservoir is at low pressure and is automatically flushed into the main reservoir when liquid refrigerant accumulates to a predetermined level. The pressure difference between the low pressure auxiliary reservoir and the typical high pressure of the discharge of the compressor creates a rapid flow of hot gas through the evaporator coils, thereby ensuring a quick defrost of the refrigeration coils. Furthermore, the suction header is fed with low pressure gas, whereby preventing the adverse effects of hot gas and high head pressure on the compressors. Although this patent is fully operational and provides many advantages, the use of two reservoirs as well as an automation system for flushing the auxiliary reservoir proves to be an expensive solution for smallscale systems, such as systems with only one evaporator and compressor.

DISCLOSURE OF THE INVENTION

It is a feature of the present invention to provide an alternative method of defrosting evaporators at high speed for small-scale systems.

It is a further feature of the present invention to use this alternative method simultaneously with refrigeration cycles for medium-scale systems.

It is a still further feature of the present invention to use this alternative method simultaneously with refrigeration cycles for large-scale systems.

SUMMARY OF THE INVENTION

According to the above aim of the present invention, and according to a broad aspect thereof, there is provided a high-speed evaporator defrost system comprising a defrost conduit circuit. The defrost conduit circuit has valve means for directing hot high pressure refrigerant gas from a discharge line of at least one compressor and through a refrigeration coil of at least one evaporator of a refrigeration system during a defrost cycle thereof, and back to a suction header of the compressor through a reservoir of the refrigeration system to remove any liquid refrigerant contained in the refrigerant gas prior to returning to the suction header. The reservoir has an internal pressure which is generally at the same pressure as that of a suction header of the compressor thereby creating a pressure differential across the refrigeration coil sufficient to accelerate the hot high pressure refrigerant gas in the discharge line through the refrigeration coil of the evaporator to quickly defrost the refrigeration coil. The reservoir is repressurized after the defrost cycle for using the reservoir in a refrigeration cycle.

According to a further broad aspect of the present invention there is provided a high-speed evaporator defrost system comprising a defrost conduit circuit. The defrost conduit circuit has valve means for directing hot high pressure refrigerant gas from a discharge line of at least one compressor and through a refrigeration coil of at least one evaporator of a refrigeration system during a defrost cycle thereof, and back to a suction header of the compressor through a reservoir of the refrigeration system to remove any liquid refrigerant contained in the refrigerant gas prior to returning to the suction header. The refrigeration system has at least another evaporator in a refrigeration cycle. The reservoir has an internal pressure which is generally at the same pressure as that of a suction header of the compressor thereby creating a pressure differential across the refrigeration coil sufficient to accelerate the hot high pressure refrigerant gas in the discharge line through the refrigeration coil of the evaporator to quickly defrost the refrigeration coil. The reservoir is repressurized after the defrost cycle for using the reservoir in the refrigeration cycle.

According to a still further broad aspect of the present invention there is provided a high-speed evaporator defrost system comprising a defrost conduit circuit. The defrost conduit circuit has valve means for directing hot high pressure refrigerant gas from a discharge line of at least one compressor and through a refrigeration coil of at least one evaporator of a refrigeration system during a defrost cycle thereof, and back to a suction header of the compressor through a principal reservoir of the refrigeration system to remove any liquid refrigerant contained in the refrigerant gas prior to returning to the suction header. The refrigeration system has at least another evaporator in a refrigeration cycle. The principal reservoir has an internal pressure which is generally at the same pressure as that of a suction header of the compressor thereby creating a pressure differential across the refrigeration coil sufficient to accelerate the hot high pressure refrigerant gas in the discharge line through the refrigeration coil of the evaporator to quickly defrost the refrigeration coil. The defrost system has a buffer reservoir for use in the refrigeration cycle for accumulating high pressure refrigerant liquid therein. The principal reservoir is repressurized after the defrost cycle for use in the refrigeration cycle.

BRIEF DESCRIPTION OF THE DRAWINGS

A preferred embodiment of the present invention with reference to examples thereof will now be described in detail having reference to the accompanying drawings in which.

DESCRIPTION OF THE PREFERRED EMBODIMENT

Figure 1:
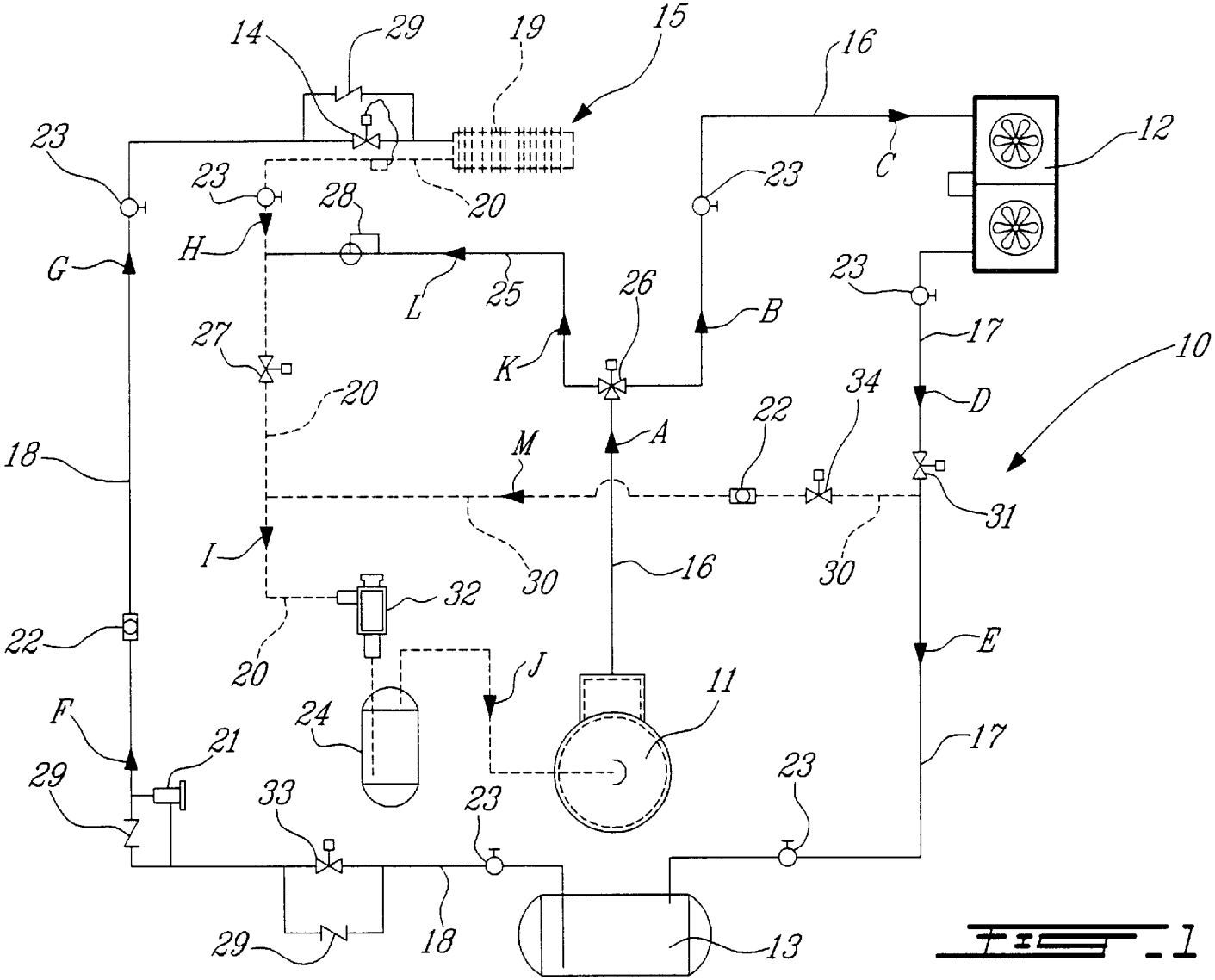
FIG. 1 is a schematic diagram of a refrigeration system adapted for operating a defrost cycle according to the present invention.

Referring to FIG. 1, there is shown generally at 10 a refrigeration system for feeding a refrigerant to an evaporator associated with a refrigeration unit such as a refrigerated display case or a frozen food enclosure. The system is provided with a compressor 11, a condenser 12, a refrigerant reservoir 13, an expansion valve 14 and an evaporator 15. The system 10 contains a refrigerant which is used for its properties and which changes phases throughout refrigeration and defrost cycles. The refrigerant, in a high pressure hot gas state, is fed from the compressor 11 to the condenser 12 by a discharge line 16, following arrows A, B and C depicted in FIG. 1. After being cooled in the condenser 12 as known in the art, the refrigerant, now in the state of a high pressure liquid/gas mixture, conveys to the refrigerant reservoir 13 through condenser line 17, following arrows D and E. High pressure liquid refrigerant then reaches the evaporator 15 through a liquid line 18, in the direction of arrows F and G, wherein the expansion valve 14 substantially reduces the liquid refrigerant pressure. Low pressure liquid refrigerant is vaporized in an evaporator coil 19 within the evaporator 15, whereon air is blown to cool a refrigerated display case or frozen food enclosure (not shown). The refrigerant, in a low pressure gas state, then conveys from the evaporator coil 19 to the compressor 11, via a suction line 20, and illustrated by arrows H and I.

The refrigeration cycle described above further comprises known in the art elements such as a dryer 21, a sight glass 22 and a plurality of maintenance valves 23. Furthermore, an accumulator 24 within the suction line 20 ensures that the refrigerant reaching the compressor is in a gaseous state.

In a defrost cycle, hot gas refrigerant discharged at high pressure from the compressor 11 is fed to the evaporator 15, whereas it is fed to the condenser 12 in the refrigeration cycle. This is achieved by a hot gas line 25 diverging from the discharge line 16 to reach the suction line 20. A three-way valve 26 conveys the high pressure hot gas refrigerant discharged from the compressor 11 to the hot gas line 25, following arrows A, K and L. Other valve systems such as a solenoid three-way valve, a pair of two way valves or the like may be used for the hereinabove described purpose. A valve 27, normally open on the suction line 20, is closed to direct the high pressure hot gas refrigerant from the hot gas line 25 to the evaporator 15, in a direction opposite arrow H. A pressure regulator 28 located on the hot gas line 25 and as known in the art, lowers the pressure of the hot gas refrigerant passing therethrough. The low pressure hot gas flows through the evaporator coil 19 in a direction opposite from that of the refrigeration cycle, thereby heating the coil 19 to defrost it from the ice build-up thereon. The pressure drop resulting from the pressure regulator 28 ensures a rapid flow of hot gas refrigerant through the coil 19.

Simultaneously with the above described diversion of hot gas refrigerant toward the evaporator 15 by the three-way valve and by the closure of valve 27, a valve 33 on the liquid line 18, normally open during the refrigeration cycle, is closed for preventing the high pressure liquid refrigerant of the reservoir B to flow toward the evaporator 15. Furthermore, a valve 31 on the condenser line 17, also normally open during the refrigeration cycle, is shut, whereby to prevent the high pressure liquid/gas refrigerant to flow back to the condenser 12. Instead, the reservoir 13 is connected to the suction line 20 by a depressurizing line 30, wherein a valve 34, normally closed during the refrigeration cycle, is opened in the defrost cycle to allow the flow of high pressure gas refrigerant to the suction line 20, following arrow M. A pressure regulator 32, located upstream of the compressor 11, reduces the pressure of refrigerant, as known in the art, in a closed part of the system 10 defined by the portion of the liquid line 18 from the valve 33 to the reservoir 13, the portion of the condenser line 17 from the reservoir 13 to the valve 31, the reservoir 13, the depressurizing line 30, and the portion of the suction line 20 extending from the valve 27 to the pressure regulator 32. The above defined closed part of the system consequently becomes the low pressure portion of the system 10.

The refrigerant, in a low pressure liquid/gas state, may then flow from the evaporator 15 to the reservoir 13 in the liquid line 18, in a direction opposite arrows G and F. The liquid encompasses the expansion valve 14, the dryer 21 and the valve 23 by passing through the unidirectional by-pass valves 29, to reach the refrigerant reservoir 13, now containing a low pressure liquid-gas refrigerant mixture. Thereafter, the pressure drop at the compressor 11 inlet collects the gas from the refrigerant reservoir 13 by the depressurizing line 30, thereby closing the defrost cycle loop. The pressure regulator further 32 ensures that the head pressure in the suction line 20 of the compressor 11 is kept low, while the accumulator 24 still prevents liquid from entering the compressor 11.

Once the defrost cycle is over, the refrigeration system 10 returns to the refrigeration cycle, wherefore valves 27, 31 and 33 return to their normally open position and valve 34 is closed. The three-way valve 26 is actuated to direct the compressor discharge to the condenser 12, whereby the reservoir is repressurized with high pressure refrigerant for the operation of the refrigeration cycle.

In keeping the refrigerant reservoir in low pressure during the defrost cycles, a high pressure differential is kept to accelerate the high pressure hot gas refrigerant flowing through the evaporators, thereby accelerating the defrost cycles. Furthermore, the compressors are supplied with gas refrigerant resulting from the depressurization of the refrigerant reservoir, whereby a sufficient amount of hot gas is supplied to the evaporator in the defrost cycle. Liquid return to the compressors is also prevented by a system of unidirectional valves and accumulators.

Figure 2:
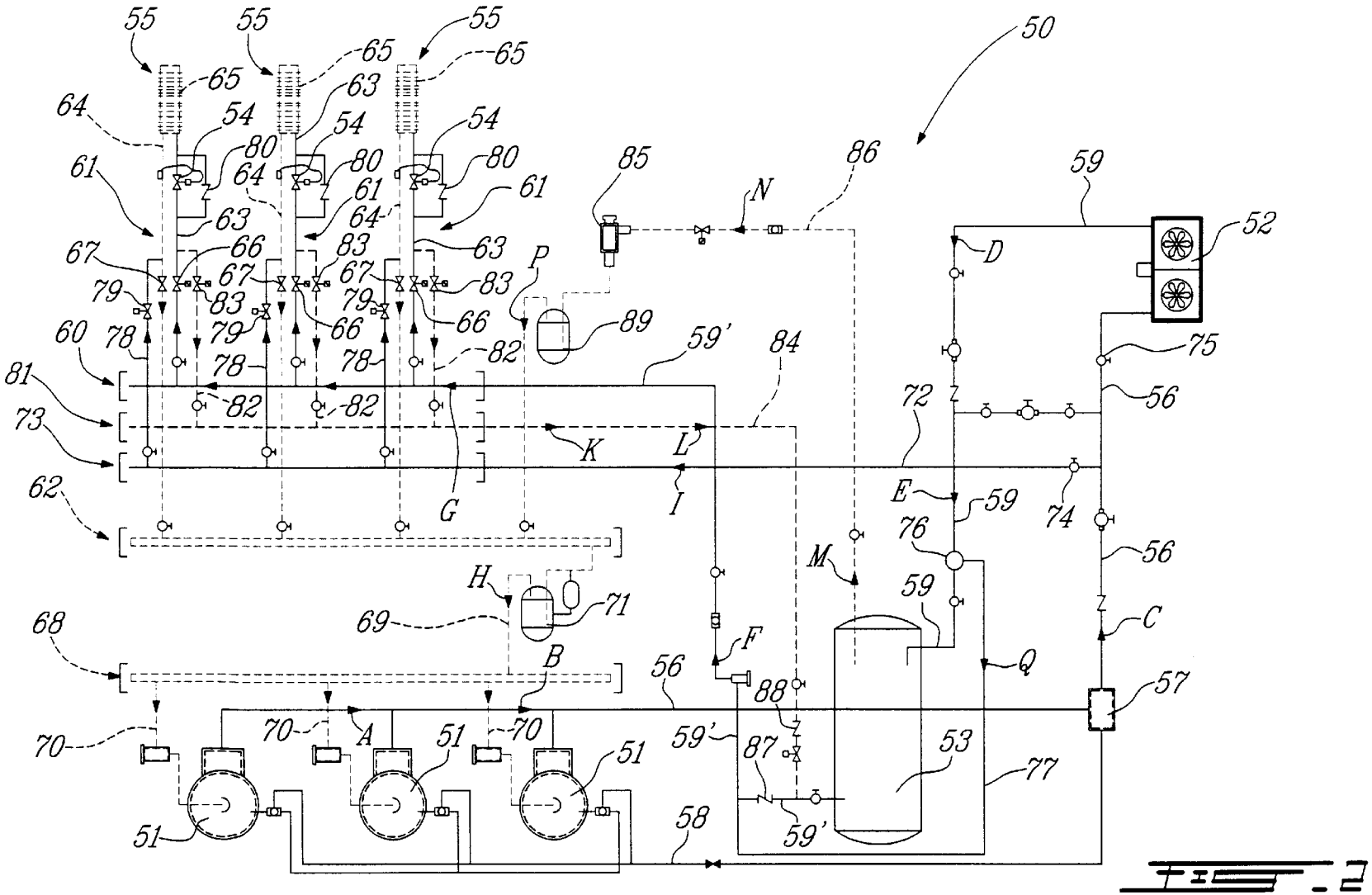
FIG. 2 is a schematic diagram of a refrigeration system adapted to operate a defrost cycle simultaneously with a refrigeration cycle.

The defrost cycle for the refrigeration system 10 depicted in FIG. 1, utilizing depressurization and repressurization of the refrigerant reservoir 13 for switching from and to the refrigeration cycle, may be operated in parallel with the refrigeration cycle in systems comprising more than one evaporator, i.e. an evaporator may be defrosting while another is refrigerating. Referring thus to FIG. 2, there is generally shown at 50 a refrigeration system for feeding a refrigerant to evaporators associated with refrigerated display cases and/or frozen food enclosures. The system is provided with compressors 51, a condenser 52, a refrigerant reservoir 53, expansion valves 54 and evaporators 55. Refrigerant gas, in a high pressure hot gas state, is fed from the compressors 51 to the condenser 12 by a discharge line 56 and following arrows A, B and C, with an oil separator 57 located thereon separating the lubricant oil from the refrigerant and returning the lubricant oil to the compressors 11 through lubricant line 58. After being cooled in the condenser 52 as known in the art, the refrigerant, now in a state of high pressure liquid/gas mixture, conveys through a condenser line 59 to the refrigerant reservoir 53 following arrows D and E, wherein the liquid and gas portion of the mixture are separated. High pressure liquid refrigerant then reaches the liquid header 60, as shown within brackets in FIG. 2, by conveying through a liquid line 59' and following arrows F and G. A first suction header 62 is connected to the liquid header 60 by evaporator circuits 61, whereby liquid refrigerant is supplied to the evaporators 55.

Each of the evaporator circuits 61 comprises an inlet line 63, an outlet line 64 and, therebetween, the evaporator 55 comprising an evaporator coil 65. Furthermore, the expansion valve 54 is located on the inlet line 63 and substantially reduces the pressure of the liquid refrigerant supplied to the evaporator coil 65. Low pressure liquid refrigerant is vaporized in the evaporator coil 65 within the evaporator 55, whereon air is blown to cool the refrigeration unit (not shown). The refrigerant, in a low pressure gas state, then conveys from the evaporator coil 65 to the suction header 62, via the outlet line 64. An inlet valve 66 and an outlet valve 67 normally open during the refrigeration cycle, are located on the inlet and outlet lines 63 and 64, may be closed to isolate the evaporator 55 from the liquid and first suction header 60 and 62, for instance when running a defrost cycle, as explained hereinafter. The refrigerant, still in a low pressure gas state, conveys from the first suction header 62 to the second suction header 68, passing through suction line 69 following arrow H. The low pressure gas refrigerant then reaches the compressors 51 through compressor lines 70, connected to the second suction header 68. Herein seen the suction line 69 comprises an accumulator 71, as known in the art, for ensuring the supply of refrigerant only in a gaseous state to the compressors 51. The refrigeration cycle described above further comprises known in the art elements, which are not all identified nor shown in FIG. 2 to simplify the figure, such as maintenance valves, dryers, sight glass and the like.

One of the evaporators 55 may be put in a defrost cycle while the others are in the above described refrigeration cycle. This is achieved by a hot gas line 72 diverging from the discharge line 56 to reach a hot gas header 73 following arrows I, shown within brackets. A valve 74 located on the hot gas line 72, normally closed when no defrost cycle is running on the refrigeration system 50, is fully opened while a valve 75 located, on the discharge line 56, between the hot gas line 72 junction and the condenser 52 is slightly closed to ensure hot gas refrigerant will reach the hot gas header 73. The refrigeration cycle will continue in the manner explained above, with the exception that a three-way valve 76 on the condenser line 59 redirects the liquid/gas mixture of refrigerant, coming from the condenser 52, to a bypass circuit 77 and following arrow Q, whereby the mixture of refrigerant bypasses the reservoir 53. The bypass circuit is connected to the liquid line 59', whereby the evaporators 55 are supplied with refrigerant, as explained hereinabove. A unidirectional valve 87 as known in the art prevents the refrigerant from entering the reservoir 53 upon reaching the liquid line 59'.

In order to supply one of the evaporators 55 with hot gas refrigerant for defrosting purposes, the inlet and outlet valves 66 and 67 are shut, thereby preventing flow of liquid refrigerant from the liquid header 60 or the first suction header 62. Defrost lines 78 connect the hot gas header 73 to a portion of the outlet lines 64 of the evaporator circuits 61, between the evaporator 65 and the outlet valves 67. The defrost lines 78 further comprise valves 79 located thereon, specifically opened for the defrost cycle of an evaporator 55. The valves 79 also serve the purpose of reducing the pressure of the hot gas refrigerant passing therethrough, as known in the art. Therefore, low pressure hot gas refrigerant flows through the evaporator coil 65 of the evaporator 55 being defrosted, thereby heating the evaporator coil 65 to defrost it from the ice build up thereon. The pressure drop resulting from the valve 79 ensures a rapid flow of hot gas refrigerant through the coil 65. The refrigerant, in a fluid/gas mixture, then flows through the inlet line 63 and bypasses the expansion valve 54 by passing through a unidirectional bypass valve 80. The fluid/gas refrigerant thereafter reaches a defrost return header 81, as shown in brackets in FIG. 2. A defrost return line 82 connects the inlet line 63 to the defrost return header 81. The defrost return line 82 also comprises a valve 83, specifically opened for the defrost cycle.

Simultaneously with the above described diversion of hot gas refrigerant toward one of the evaporators 55 by the hot gas line 72, a pressure regulator 85 reduces the pressure of refrigerant, as known in the art, in a closed part of the refrigeration system 50 defined by the reservoir 53 and a reservoir return line 86, thereby depressurizing the reservoir 53. This part of the system 10 is closed as unidirectional valves 87 and 88 and three-way valve 76 isolate the reservoir 53 from the rest of the system 50. When the pressure in the reservoir 53 reaches a lower value than the pressure of the liquid/gas refrigerant within the defrost return header 81, the liquid/gas refrigerant flows therefrom through the unidirectional valve 88, in the direction shown by arrow L. Thereafter, the low pressure in the first suction header 62, resulting from the connection of the first suction header to an inlet side of the compressor 51, ensures a flow of gas refrigerant from the reservoir 53 to the first suction header 62 via the reservoir return line 86 and in the direction shown by arrows M and N. An accumulator 89, known in the art, ensures that refrigerant only in a gaseous state reaches the first suction header 62.

Figure 3:
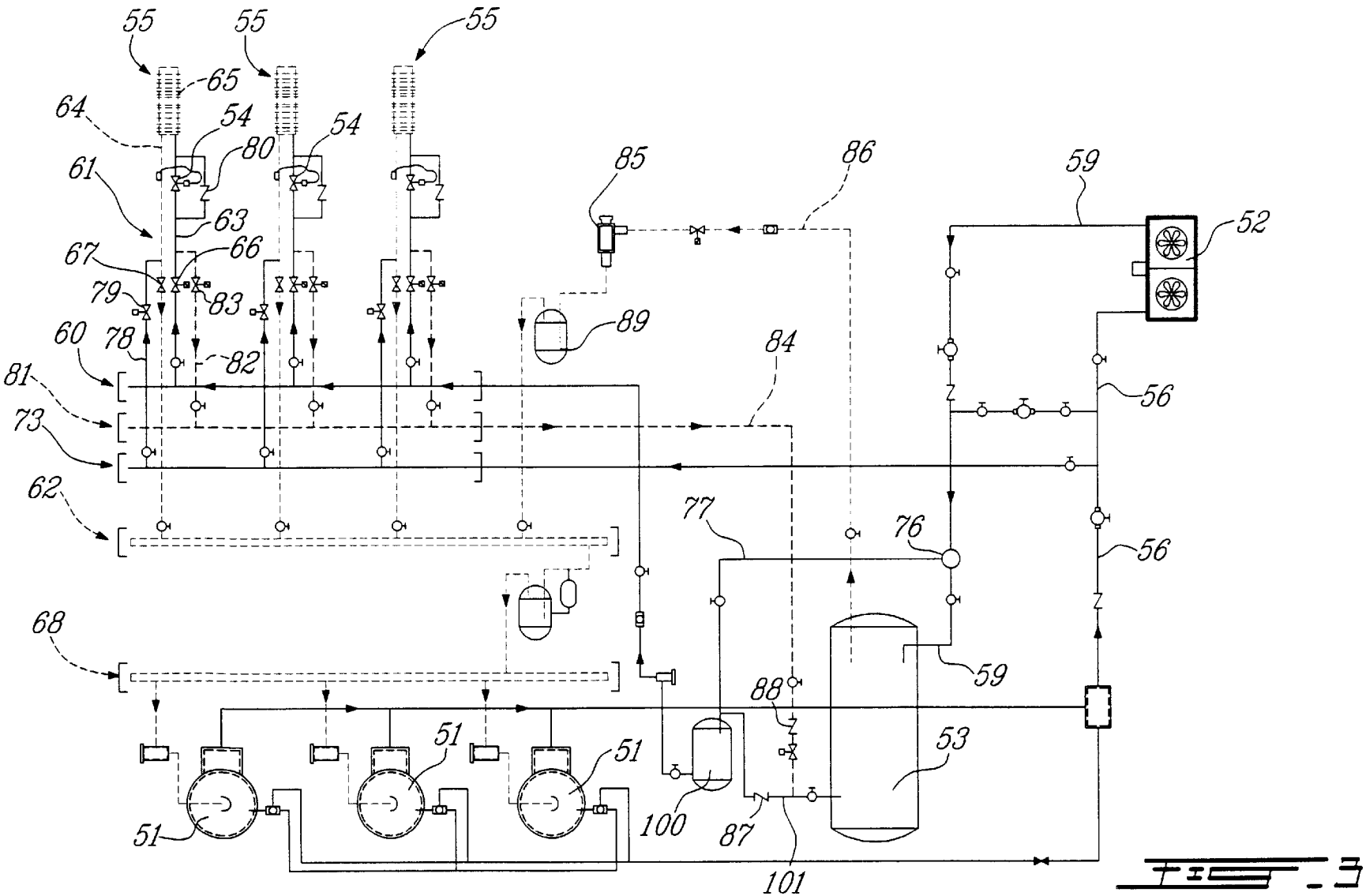
FIG. 3 is a schematic diagram of a refrigeration system operating a defrost cycle simultaneously with a refrigeration cycle with a buffer reservoir.

The defrost cycle for the refrigeration system 50 depicted in FIG. 2, activated simultaneously with the refrigeration cycle for a plurality of evaporators 55, is shown in FIG. 3 with a buffer reservoir 100, whereby ensuring a continuous supply of liquid refrigerant to the evaporators 55 in the refrigeration cycle. The refrigeration system depicted in FIG. 3 is identical to the refrigeration system 50 of FIG. 2 apart from a few differences, which will be described hereinafter. Thus, like numerals will determine like elements. Furthermore, only the main elements are numbered on FIG. 3 for the simplicity of the illustration.

The buffer reservoir 100 is added to the liquid line 59' of the previous refrigeration system 50 of FIG. 2. Thus, the line now connecting the refrigerant reservoir 53 to the buffer reservoir 100 will be referred to as the transfer line 101. The transfer line 101 includes the unidirectional valve 87, whereby ensuring that liquid refrigerant may only flow from the refrigerant reservoir 53 to the buffer reservoir 100. A liquid line 102 thereafter connects the buffer reservoir 100 to the liquid header 60. As shown, the bypass circuit 77 is upstream of the buffer reservoir 100.

The refrigeration system of FIG. 3 operates in the same manner as the refrigeration system 50 of FIG. 2, with the difference being that the liquid/gas refrigerant mixture exiting from the condenser 52 and conveying through condenser line 59, will accumulate in the buffer reservoir 100 through transfer line 101. Once the buffer reservoir 100 is full, the refrigerant reservoir 53 will then be filled. When a defrost cycle is initiated, the three-way valve 76 will redirect the high pressure liquid/gas refrigerant mixture from the condenser 52 to the buffer reservoir 100 through the bypass circuit 77. As explained for FIG. 2, the refrigerant reservoir 53 is depressurized to serve as a reservoir for low pressure liquid/gas refrigerant mixture exiting from the defrosting evaporators. The buffer reservoir 100 thus ensures the continuous supply of high pressure liquid refrigerant to the evaporators in the refrigeration cycle.

As herein shown, the refrigeration systems of the present invention use the main reservoir, i.e. refrigerant reservoir, to maintain a low pressure in the system during the defrost cycles. They also allow for the efficient defrosting of evaporators working at low and medium temperatures, such as frozen food enclosures and refrigerated display cases. An advantage of the present invention resides in the fact that evaporators can be defrosted on a refrigeration system having only one refrigeration circuit and one compressor. The refrigeration systems of the present invention operate at low compressor head pressure, which provides better energy efficiency. The refrigeration system of the present invention are enabled to be adapted to existing evaporators without modification.

It is within the ambit of the present invention to cover any obvious modifications of the embodiments described herein, provided such modifications fall within the scope of the appended claims.

What is claimed is:

1. A high-speed evaporator defrost system comprising a defrost conduit circuit having valve means for directing hot high pressure refrigerant gas from a discharge line of at least one compressor and through a refrigeration coil of at least one evaporator of a refrigeration system during a defrost cycle thereof, and back to a suction header of said at least one compressor through a reservoir of said refrigeration system to remove any liquid refrigerant contained in said refrigerant gas prior to returning to said suction header, said reservoir having an internal pressure which is generally at the same pressure as that of a suction header of said at least one compressor thereby creating a pressure differential across said refrigeration coil sufficient to accelerate said hot high pressure refrigerant gas in said discharge line through said refrigeration coil of said evaporator to defrost said refrigeration coil, said reservoir being repressurized after said defrost cycle for using said reservoir in a refrigeration cycle.

2. The high-speed evaporator defrost system according to claim 1, wherein said valve means comprises a first valve in said discharge line and a second valve in said suction header for directing said hot high pressure refrigerant gas from said at least one compressor to said at least one evaporator.

3. The high-speed evaporator defrost system according to claim 2, wherein said valve means further comprises a third valve and a unidirectional flow mechanism located upstream of said reservoir in a liquid line during said defrost cycle, whereby to ensure flow of refrigerant gas/liquid from said evaporator to said reservoir during said defrost cycle, said liquid line joining said reservoir to said evaporator during said refrigeration cycle.

4. The high-speed evaporator defrost system according to claim 3, wherein said valve means further comprises at least a fourth valve in a condenser line for directing refrigerant gas from said reservoir to said suction header, said condenser line joining a condenser unit to said reservoir during said refrigeration cycle.

5. The high-speed evaporator defrost system according to claim 1, wherein a first pressure regulator is located downstream of said reservoir in said suction header during said defrost cycle to control said internal pressure of said reservoir.

6. The high-speed evaporator defrost system according to claim 5, wherein a second pressure regulator is located upstream of said evaporator in said discharge line during said defrost cycle to control said hot high pressure refrigerant gas therein, said second pressure regulator creating, with said first pressure regulator, said pressure differential across said refrigeration coil.

7. The high-speed evaporator defrost system according to claim 1, wherein said valve means directs said hot high pressure refrigerant gas to said reservoir through a condenser unit of said refrigeration system in said refrigeration cycle, thereby repressurizing said reservoir.

8. A high-speed evaporator defrost system comprising a defrost conduit circuit having valve means for directing hot high pressure refrigerant gas from a discharge line of at least one compressor and through a refrigeration coil of at least one evaporator of a refrigeration system during a defrost cycle thereof, and back to a suction header of said at least one compressor through a reservoir of said refrigeration system to remove any liquid refrigerant contained in said refrigerant gas prior to returning to said suction header, said refrigeration system having at least another evaporator in a refrigeration cycle, said reservoir having an internal pressure which is generally at the same pressure as that of a suction header of said at least one compressor thereby creating a pressure differential across said refrigeration coil sufficient to accelerate said hot high pressure refrigerant gas in said discharge line through said refrigeration coil of said evaporator to defrost said refrigeration coil, said reservoir being repressurized after said defrost cycle for using said reservoir in said refrigeration cycle.

9. The high-speed evaporator defrost system according to claim 8, wherein said valve means comprises at least a first valve in said discharge line for directing a portion of said hot high pressure refrigerant gas from said at least one compressor to said at least one evaporator during said defrost cycle.

10. The high-speed evaporator defrost system according to claim 9, wherein said valve means comprises a second valve in a condenser line for directing another portion of said hot high pressure refrigerant gas from said discharge line to said another evaporator in said refrigeration cycle when said refrigeration cycle is simultaneous with said defrost cycle, thereby bypassing said reservoir; said condenser line joining a condenser unit to said reservoir when said reservoir is in said refrigeration cycle.

11. The high-speed evaporator defrost system according to claim 8, wherein a first pressure regulator is located downstream of said reservoir in a reservoir return line during said defrost cycle to control said internal pressure of said reservoir, said reservoir return line joining said reservoir to said suction header during said defrost cycle.

12. The high-speed evaporator defrost system according to claim 11, wherein a second pressure regulator is located upstream of said evaporator in said discharge line during said defrost cycle to control said hot high pressure refrigerant gas therein; said second pressure regulator creating, with said first pressure regulator, said pressure differential across said refrigeration coil of said evaporator in said defrost cycle.

13. The high-speed evaporator defrost system according to claim 8, wherein said valve means directs said hot high pressure refrigerant gas to said reservoir through a condenser unit of said refrigeration system in said refrigeration cycle, thereby repressurizing said reservoir for use in said refrigeration cycle.

14. A high-speed evaporator defrost system comprising a defrost conduit circuit having valve means for directing hot high pressure refrigerant gas from a discharge line of at least one compressor and through a refrigeration coil of at least one evaporator of a refrigeration system during a defrost cycle thereof, and back to a suction header of said at least one compressor through a principal reservoir of said refrigeration system to remove any liquid refrigerant contained in said refrigerant gas prior to returning to said suction header, said refrigeration system having at least another evaporator in a refrigeration cycle, said principal reservoir having an internal pressure which is generally at the same pressure as that of a suction header of said at least one compressor thereby creating a pressure differential across said refrigeration coil sufficient to accelerate said hot high pressure refrigerant gas in said discharge line through said refrigeration coil of said evaporator to defrost said refrigeration coil, said defrost system having a buffer reservoir for use in said refrigeration cycle for accumulating high pressure refrigerant liquid therein, said principal reservoir being repressurized after said defrost cycle for use in said refrigeration cycle.

15. The high-speed evaporator defrost system according to claim 14, wherein said valve means comprises at least a first valve in said discharge line for directing a portion of said hot high pressure refrigerant gas from said at least one compressor to said at least one evaporator in said defrost cycle.

16. The high-speed evaporator defrost system according to claim 15, wherein said valve means comprises a second valve in a condenser line for directing another portion of said hot high pressure refrigerant gas from said discharge line to said another evaporator in said refrigeration cycle through said buffer reservoir when said refrigeration cycle is simultaneous with said defrost cycle, thereby bypassing said principal reservoir; said condenser line joining a condenser unit to said principal reservoir when said principal reservoir is in said refrigeration cycle.

17. The high-speed evaporator defrost system according to claim 14, wherein a first pressure regulator is located downstream of said principal reservoir in a reservoir return line during said defrost cycle to control said internal pressure of said principal reservoir, said reservoir return line joining said principal reservoir to said suction header during said defrost cycle.

18. The high-speed evaporator defrost system according to claim 17, wherein a second pressure regulator is located upstream of said evaporator in said discharge line during said defrost cycle to control said hot high pressure refrigerant gas therein; said second pressure regulator creating, with said first pressure regulator, said pressure differential across said refrigeration coil of said evaporator in said defrost cycle.

19. The high-speed evaporator defrost system according to claim 14, wherein said valve means directs said hot high pressure refrigerant gas to said principal reservoir through a condenser unit of said refrigeration system in said refrigeration cycle, thereby repressurizing said principal reservoir for use in said refrigeration cycle.

20. The high-speed evaporator defrost system according to claim 19, wherein said principal reservoir is connected in series with said buffer reservoir in said refrigeration cycle, thereby supplying said buffer reservoir with high pressure refrigerant liquid.

* * * * *